US006732671B2

(12) United States Patent
Johnson

(10) Patent No.: US 6,732,671 B2
(45) Date of Patent: May 11, 2004

(54) TOOL TO REMOVE WEEDS FROM ITEMS LOCATED ON AQUATIC VEHICLES

(75) Inventor: Jeffrey T. Johnson, West St. Paul, MN (US)

(73) Assignee: Personal Watercraft Works, LLC, Parrish, FL (US)

( * ) Notice: Subject to any disclaimer, the term of this patent is extended or adjusted under 35 U.S.C. 154(b) by 0 days.

(21) Appl. No.: 10/047,929

(22) Filed: Oct. 23, 2001

(65) Prior Publication Data

US 2002/0120992 A1 Sep. 5, 2002

Related U.S. Application Data

(60) Provisional application No. 60/242,596, filed on Oct. 23, 2000.

(51) Int. Cl.[7] ..... B63B 9/00

(52) U.S. Cl. ..... 114/221 R; 15/143.1

(58) Field of Search ..... 114/221 R, 222; 294/19.1; 15/143.1, 1.7, 159.1, 160, 176.1, 207.2

(56) References Cited

U.S. PATENT DOCUMENTS

| | | | | | |
|---|---|---|---|---|---|
| 2,181,189 | A | * | 11/1939 | Lathan | 294/55.5 |
| 2,289,313 | A | * | 7/1942 | Cave | 15/199 |
| 2,624,061 | A | * | 1/1953 | Leas | 15/144.4 |
| 3,048,139 | A | * | 8/1962 | Ducket | 114/221 R |
| 3,993,013 | A | * | 11/1976 | Nunziato et al. | 114/221 R |
| 4,004,539 | A | * | 1/1977 | Wesson | 114/221 R |
| 4,060,047 | A | * | 11/1977 | Sabella | 114/222 |
| 4,291,432 | A | * | 9/1981 | Cogswell | 114/221 R |
| D264,424 | S | * | 5/1982 | Clark | D8/13 |
| D301,674 | S | * | 6/1989 | Smith et al. | D8/13 |
| 4,909,173 | A | * | 3/1990 | Strong | 114/222 |
| 5,003,907 | A | * | 4/1991 | Roach et al. | 114/221 R |
| 5,269,040 | A | * | 12/1993 | Switall | 15/244.1 |
| 5,505,154 | A | * | 4/1996 | Urie et al. | 114/222 |
| 5,570,919 | A | * | 11/1996 | Eusebe | 294/19.1 |
| 5,634,232 | A | * | 6/1997 | Brenneman | 15/160 |
| 5,937,473 | A | * | 8/1999 | Lisowski | 15/236.08 |
| 6,438,785 | B1 | * | 8/2002 | Smith | 15/160 |
| 6,450,871 | B1 | * | 9/2002 | Morrison et al. | 452/6 |

OTHER PUBLICATIONS

Merriam–Webster's Collegiate Dictionary, Tenth Edition , "tine" p. 1236, Merriam–Webster, Inc. 1998.*

* cited by examiner

*Primary Examiner*—Andrew Wright
(74) *Attorney, Agent, or Firm*—Vidas, Arrett & Steinkraus

(57) ABSTRACT

A tool to dislodge and clear weeds and debris from grates on personal water craft and from platforms, inboard and outboard propellers and anchors on boats either from along side or onboard the aquatic vehicle. It also allows for the user to rotate and manipulate the tool with ease in order to dislodge, loosen and remove weeds and/or debris wrapped around grates, anchors, platforms and/or propellers. The tool consists of an elongated slightly curved handle that has a ridged grip with a hole through the end at one end of the handle and a pronged means at the opposite end.

5 Claims, 4 Drawing Sheets

TOOL TO REMOVE WEEDS FROM ITEMS LOCATED ON AQUATIC VEHICLES

CROSS-REFERENCE TO RELATED APPLICATIONS

This application is a utility application derived from Provisional Patent Application No. 60/242,596 filed Oct. 23, 2000, the contents of which are hereby incorporated herein by reference.

STATEMENT REGARDING FEDERALLY SPONSORED RESEARCH OR DEVELOPMENT

Not Applicable.

FIELD OF THE INVENTION

The present invention relates generally to tools that perform clearing operations on aquatic vehicles and more particularly to a tool for the clearing of weeds and/or debris which clog and wrap around grates, anchors, propellers, motors and swim platforms attached to jet skis and boats.

BACKGROUND OF THE INVENTION

With the use of water craft of all sizes becoming more prevalent in all types of bodies of water, the collection of weeds and/or debris in grates, around propellers, on anchors and swim platforms—basically any portion of a water craft that is being dragged through or chums through water and or sand—has become troublesome. On personal water craft, the user has to dive under or at the least become partially submerged under the vehicle in order to remove weeds clogging the intake grate. On boats, especially larger boats, the user usually has to hang over the edge of the boat to remove weeds which can wrap around the anchor or swim platform or be in the water opposite the propellers or bent over the back end of the vehicle to reach the propellers. Each of these situations being uncomfortable, inconvenient and potentially dangerous.

The purpose of the invention is to provide a tool that is versatile in use for the variety of items on a water craft which can become tangled or clogged with weeds and/or debris. A tool that is simple in design for user convenience with ease of storage and for ease of access.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

BRIEF SUMMARY OF THE INVENTION

It is the primary objective of the invention to provide a versatile tool which can clear weeds and/or debris from intake grates, swim platforms, anchors, motors and propellers located on or attached to aquatic vehicles.

It is an objective of this invention to be a tool that can be used from along side or in/on the aquatic vehicle.

It is an objective of this invention to be a tool that can be stored in such a fashion as to be easily accessible to the user for the use(s) identified above.

It is an objective of this invention to provide a tool that will float so as not to become lost if the tool is dropped in the water.

In accordance with these and other objectives of the invention, there is provided a one piece unit consisting of an elongated slightly curved handle that has a ridged grip with a hole through the end at one end of the handle and a pronged means at the opposite end.

The tool to dislodge and clear weeds and debris from grates on personal water craft and from platforms, inboard and outboard propellers and anchors on boats either from along side or onboard the aquatic vehicle. The tool has a slightly curved elongated handle with a ribbed grip on one end and a mullet pronged head at the opposite end. The ribbed grip, handle and prongs are attached and form one singular piece. The ribbed grip is composed of hard plastic ridges which encircle the handle portion perpendicular to the length of the handle and makes the tool as easy to handle wet as when dry. It also allows for the user to rotate and manipulate the tool with ease in order to dislodge, loosen and remove weeds and/or debris wrapped around grates, anchors, platforms and/or propellers. The ridged grip end has a small hole drilled through the handle for the placement of a strap or chain. The handle portion of this tool is a slightly curved cylindrical rod. The slightly curved form of the handle allows the user to reach under and around the hull of the personal water craft or boat to the grate or propeller either from along side the vehicle or from on or in the vehicle. The pronged end of the tool consists of two tines permanently attached to the end opposite the grip. The user can wedge the tines/prongs between and among the weeds and/or debris wrapped around or, clogging the item on the water craft and with a push-pull action cause their removal.

BRIEF DESCRIPTION OF THE DRAWINGS

A detailed description of the invention is hereafter described with specific reference being made to the drawings in which.

DETAILED DESCRIPTION OF THE INVENTION

Figure 1:
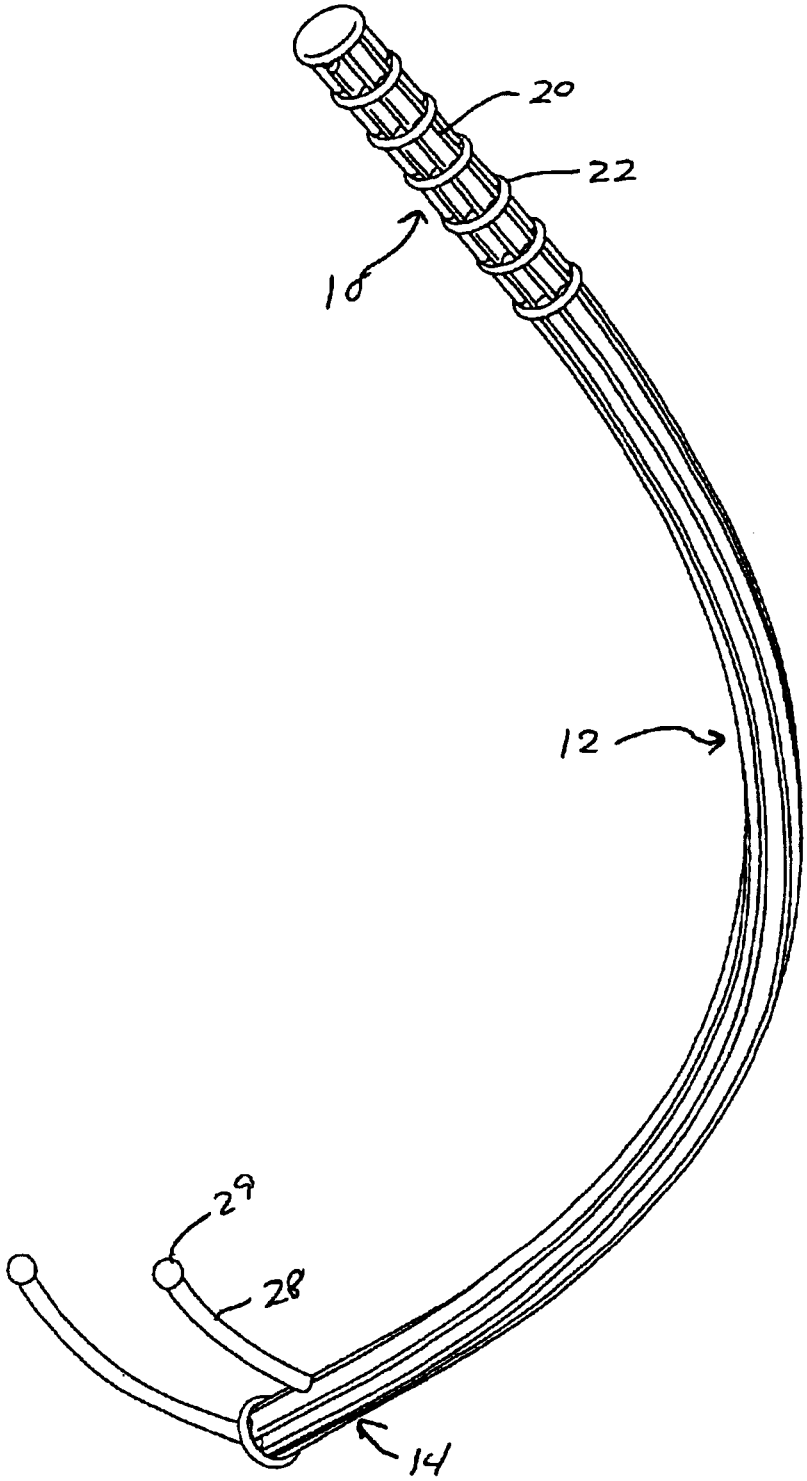
FIG. 1 is a left side view of the tool.
Figure 2:
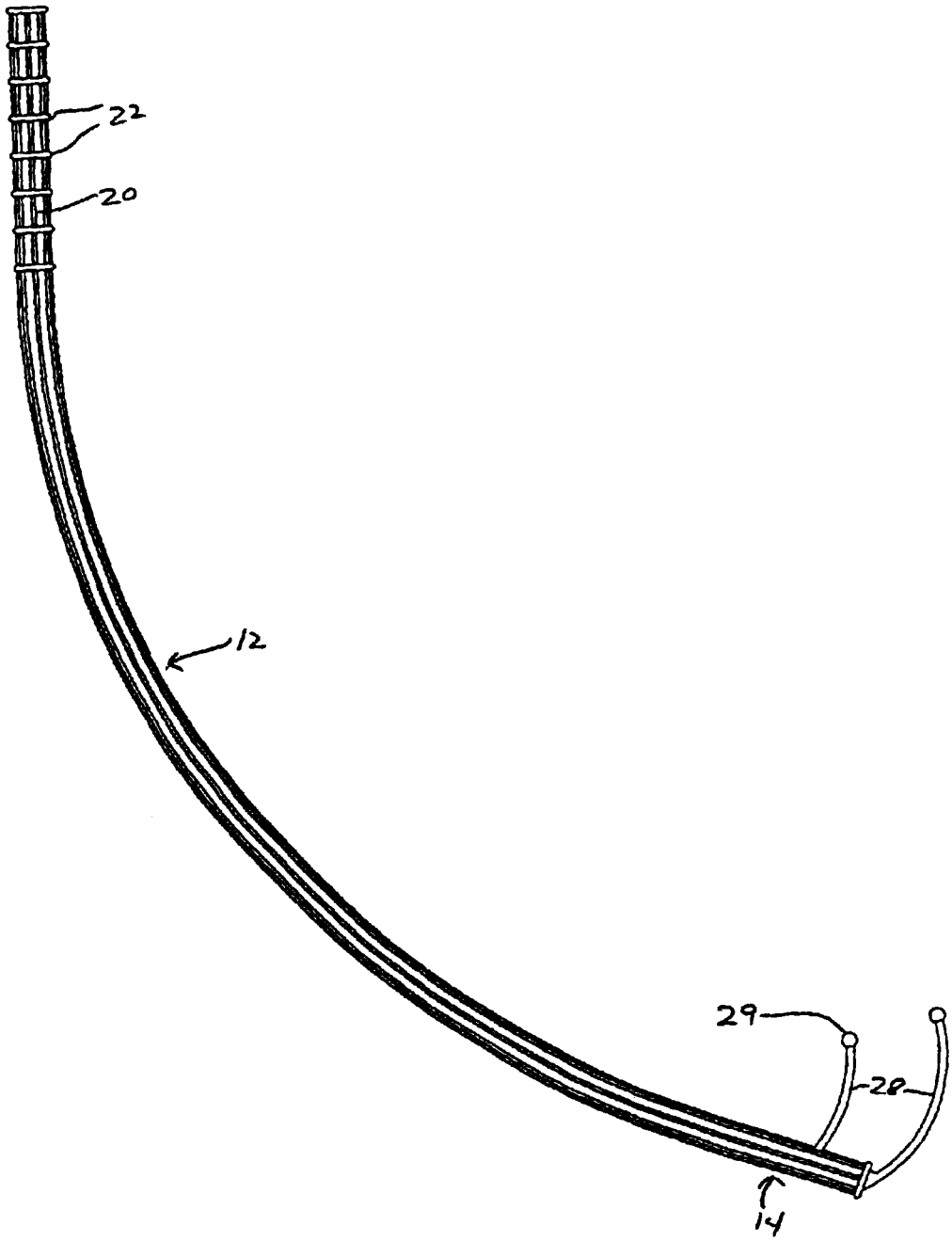
FIG. 2 is a right side view of the tool.
Figure 3:
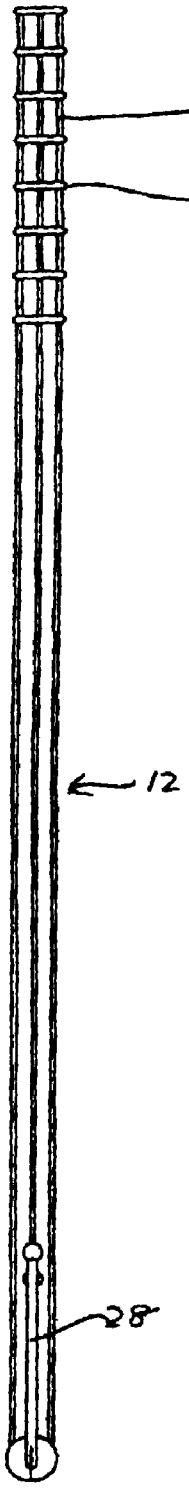
FIG. 3 is a top plan view of the tool.
Figure 4:
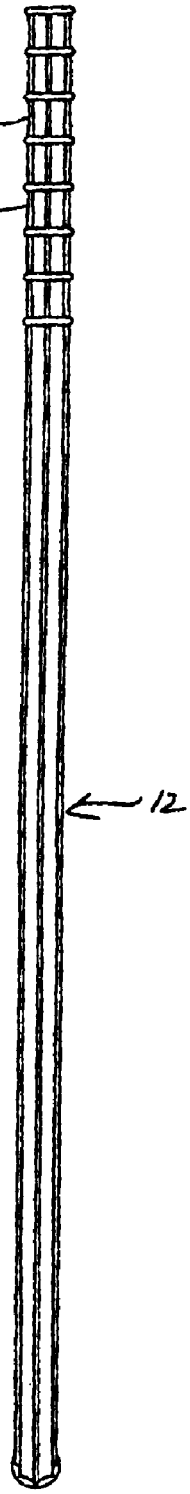
FIG. 4 is a perspective view of the tool.
Figure 5:
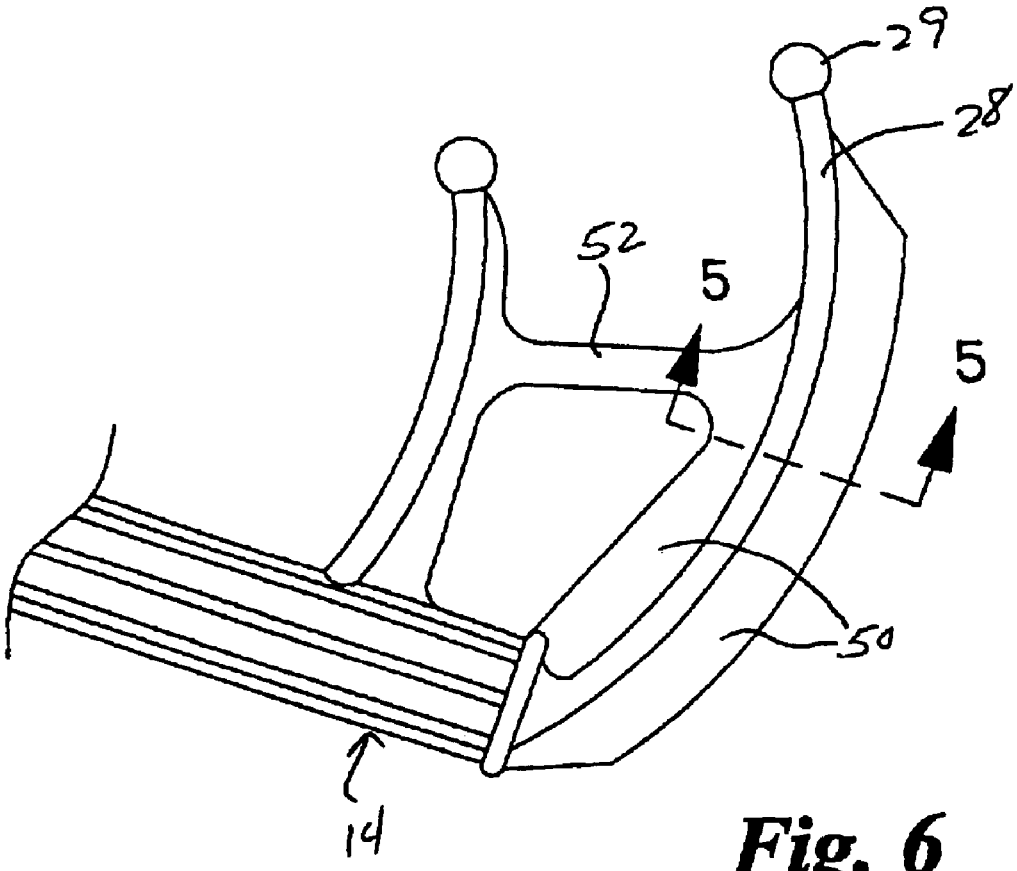
FIG. 5 is a perspective view of the tined end showing alternative bracing.
Figure 6:
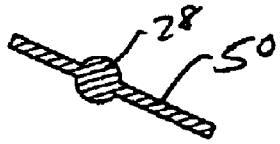
FIG. 6 is a sectional view through line 5—5 of FIG. 5.

FIG. No. 1 There is illustrated a tool for the removal of weeds and/or debris from a variety of items located on or attached to aquatic vehicles, which includes a straight handle piece 10, approximately 6 to 8 inches in length being attached to a continuous curved cylindrical rod 12 being between 18 to 25 inches in length with an arc curve between 20 degrees to 45 degrees. The curvature of the rod allows the tool to be used from on or in a marine vehicle. The curvature of the rod 12 follows the natural curvature of the hull of a jet ski or boat. The curvature gives the user additional leverage to pull and remove weeds and/or debris from the variety of items located under or along side marine vehicles where weeds and/or debris will collect and become tangled. The end of the rod 12 opposite the handle piece is a straight cylindrical piece 14 from 6 to 8 inches in length to which are attached from 2 to 4 tines evenly spaced and of descending length beginning at the outer end of the tool. The handle piece 10 is attached to one end of the rod 12 and the tined piece 14 is attached to the other end. The attachment is permanent. This makes the tool stronger and less likely to break or snap.

FIG. No. 2 The handle end of the rod consists of a cylindrical piece with indented grooves 20 running the length of the handle 10 and 6 to 8 raised ridges 22 spaced evenly along the length of the handle piece horizontal to the shaft of the rod. Whether the user of the tool is using it in a push-pull motion or a right to left motion the grooved and ridged handle helps with grip and maneuverability. There is an aperture hole 23 through the handle located at the top portion of the grip. The hole 23 is for a strap or chain. The user can place his hand and wrist through the strap to guard against accidental loss of grip or control of the tool. The user can use the strap as a hanging device adding to the storage options. The user can attached an identifying token or floater to a chain threaded throughout the aperture. The piece connected to the rod at the end opposite of the handle piece has two slightly curved tines 28. The slight curvature of the tines 28 prevents the weeds/and or debris being pulled away from the grate, propeller, or item on the watercraft from sliding off the tines. Each of the tines 28 has a small protuberance 29 on the end. These protuberances or nodules 29 are placed at the end of the tines 28 to prevent the tines from scratching or causing damage to the finish of a marine vehicle. They allow the user to work the tool back and forth to lodge the tines between the weeds in order to pull them from the clogged item. The nodules 29 also will prevent the weeds from sliding back up the shaft of the tine and remain attached to the clogged item.

FIG. No. 3 The tines 28 attach to the rod such that they project out from the rod but along the same plane as the tool. The position of the tines 28 along with the tool's curvature allows for easier onboard storage. The tool can be set along side of the running board located on a jet ski or wave runner. It can be tucked under a seat or place along the back floor portion of a boat. Such easily accessible storage locations make the tool a useful accessory and enhances its use.

FIG. No. 4 The grooves 20 running the length of the tool are shown as being continuous. They start at the end of the handle piece 10 run along the curved rod 12 and along the length of the tined piece 14. The grooves 20 aid in the tools ability to float if dropped in the water. The grooves add to the user's ability to grip the tool securely along any portion of the tool other than the handle. The grooves enhance the tools flexibility, strength and ability to be used to pry and dislodge weeds and/or debris wrapped around and clogging items located on jet skis and/or boats.

FIG. No. 5 The tines 28 may be strengthened by addition of webbing 50 and or a cross-brace 52 to make the tool even more durable. FIG. No. 6 shows a cross-section through line 5—5 to show the cross-bracing and webbing.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A tool for the removal of weeds and/or debris from grates, anchors, propellers, motors and platforms attached or a part of aquatic vehicles comprising:

a) an elongated curved rod having an arc of curvature, the rod being of sufficient length to extend to submerged portions of an aquatic vehicle such that someone standing on the aquatic vehicle can remove weeds and/or debris from an intake grate without submerging any portion of his body;

b) a multi ridged hand grip section at one end of the rod;

c) a tined section at the other end of the rod and separated from the hand grip section by a length greater than half the length of the rod, said tined section including tines, wherein the tines project substantially out from the rod in a plane substantially containing the arc of curvature of the rod, the rod curved such that a straight line or chord drawn from the tined section to the hand grip section does not cross or share space with the elongated curved rod; and d) the tines designed such that each tine has one end attached to the elongated curved rod and an end unattached to the rod, the end unattached to the rod having a protuberance, each tine strong enough to remove weeds and/or debris caught in the intake grate of an aquatic vehicle.

2. The tool of claim 1 further including an aperture opening at the end of the multi ridged hand grip section for a strap or chain for added security and leverage and storage options.

3. The tool of claim 1 constructed and arranged to float.

4. The tool of claim 1, wherein the tines are designed such that each tine has an end attached to the elongated curved rod and an end unattached to the rod, a brace bar protruding from between the end attached to the rod and the end unattached to the rod of a tine protrudes to a portion of an adjacent tine.

5. A tool for the removal of weeds and/or debris from grates, anchors, propellers, motors and platforms attached or a part of aquatic vehicles, to tool having a length and a distal and proximal end longitudinally separated from one another along the length and further comprising:

a) an elongated curved rod having an arc of curvature, the rod being of sufficient length to extend to submerged portions of an aquatic vehicle such that someone standing on the aquatic vehicle can remove weeds and/or debris from an intake grate without submerging any portion of his body, the tool constructed and arranged to float;

b) a multi ridged hand grip section at one end of the rod;

c) a tined section at the other end of the rod, said tined section including tines, wherein the tines project substantially out from the rod in a plane substantially containing the arc of curvature of the rod, the rod curved such that a straight line or chord drawn from the tined section to the hand grip section does not cross or share space with the elongated curved rod; and d) the tines designed such that each tine has one end attached to the elongated curved rod and an end unattached to the rod, the end unattached to the rod having a protuberance, each tine occupying a longitudinal position along the length of the rod substantially different from the longitudinal position of any other tine, each tine strong enough individually to remove weeds and/or debris caught in the intake grate of an aquatic vehicle.

* * * * *